United States Patent [19]

Cheung

[11] Patent Number: 4,574,006

[45] Date of Patent: Mar. 4, 1986

[54] PROCESS TO PRODUCE A KRYPTON-XENON CONCENTRATE FROM A LIQUID FEED

[75] Inventor: Harry Cheung, Buffalo, N.Y.

[73] Assignee: Union Carbide Corporation, Danbury, Conn.

[21] Appl. No.: 641,553

[22] Filed: Aug. 16, 1984

[51] Int. Cl.[4] ..... F25J 3/04

[52] U.S. Cl. ..... 62/22; 62/28; 62/30; 62/31; 62/34; 423/262

[58] Field of Search ..... 62/22, 23–34; 423/262

[56] References Cited

U.S. PATENT DOCUMENTS

| | | | |
|---|---|---|---|
| 3,596,471 | 8/1971 | Streich | 62/22 |
| 3,609,983 | 10/1971 | Lofredo et al. | 62/22 |
| 3,751,934 | 8/1973 | Frischbier | 62/41 |
| 3,768,270 | 10/1973 | Schuftan | 62/31 |
| 3,779,028 | 12/1973 | Schuftan et al. | 62/22 |
| 4,384,876 | 5/1983 | Mori et al. | 62/22 |
| 4,421,536 | 12/1983 | Mori et al. | 62/18 |

*Primary Examiner*—Frank Sever

*Attorney, Agent, or Firm*—Stanley Ktorides

[57] ABSTRACT

A process which produces a krypton-xenon concentrate from a liquid feed while also producing a liquid product substantially free of rare gases. The process employs an integral heat pump circuit to carry out the separation in an energy-efficient manner.

16 Claims, 1 Drawing Figure

PROCESS TO PRODUCE A KRYPTON-XENON CONCENTRATE FROM A LIQUID FEED

TECHNICAL FIELD

This invention relates to the production of a krypton-xenon concentrate from a liquid feed and is an improvement whereby the concentrate is produced at high efficiency and a rare gas depleted liquid is recovered as product.

BACKGROUND ART

Krypton and xenon are undergoing increasing demand in a number of applications. Krypton is being widely used in high quality lighting including long-life light bulbs and automotive lamps. Xenon is being used for medical applications including special X-ray equipment. Both of these gases are commonly used in many laboratory and research applications.

The principle source of krypton and xenon is the atmosphere. Atmospheric air contains about 1.1 ppm (parts per million) of krypton and about 0.08 ppm of xenon. Generally, krypton and xenon are recovered from the air in conjunction with a comprehensive air separation process which separates air into oxygen and nitrogen.

Due to the lower vapor pressures of krypton and xenon these gases concentrate in the oxygen rather than in the nitrogen during the air separation. The concentration of the atmospheric krypton and xenon in the oxygen increases their concentration by a factor of five because oxygen comprises only about one-fifth of the atmospheric air.

The air separation process may produce gaseous or liquid oxygen, or may produce both, and the krypton and xenon will concentrate in either oxygen product. It is desirable to further concentrate the krypton and xenon so that their separation from oxygen can be carried out efficiently. When the krypton and xenon are recovered in gaseous oxygen, and krypton-xenon concentration process must be carried out at the same time as the air separation process because it is impractical to store gaseous oxygen in the quantities produced by an air separation plant. It may thus be desirable to recover the krypton-xenon in liquid oxygen from an air separation plant, since this liquid can be stored and can be combined with other such liquids from other distant air separation plants to form a feed for a krypton-xenon concentration process.

However, removing liquid oxygen from an air separation plant is costly because of the associated refrigeration which is removed from the air separation plant with the liquid oxygen. It is thus desirable to have a krypton-xenon concentration process which uses a liquid feed but which also produces a liquid rare gas-free product.

As is known, oxygen can be hazardous if not handled properly. Therefore, known krypton-xenon concentration processes employing a liquid feed have heretofore been quite complicated in order to achieve the desired krypton-xenon concentration with the requisite safety. It is desirable therefore to provide a process which effectively concentrates krypton and xenon employing a liquid feed without the heretofore necessary excessive complications occasioned by the handling of oxygen.

It is therefore an object of this invention to provide an improved process to produce a krypton-xenon concentrate.

It is another object of this invention to provide an improved process to produce a krypton-xenon concentrate employing a liquid feed.

It is a further object of this invention to provide an improved process to produce a krypton-xenon concentrate which also produces a rare gas-free liquid product.

It is yet another object of this invention to provide a process to produce a krypton-xenon concentrate which can carry out the desired concentration without all the heretofore necessary complications of known processes.

SUMMARY OF THE INVENTION

The above and other objects which will become apparent to one skilled in the art upon a reading of this disclosure are attained by:

A process for the production of a krypton-xenon concentrate from a liquid feed, while also recovering a liquid product substantially free of rare gases, comprising:

(1) providing a feed liquid comprising oxygen, krypton and xenon to a reboiling zone to form a reboiling liquid;

(2) partially vaporizing the reboiling liquid to produce a vapor, and a liquid krypton-xenon concentrate;

(3) recovering krypton-xenon concentrate;

(4) passing the vapor against downflowing reflux liquid in a column;

(5) stripping krypton and xenon from the vapor to the reflux liquid to produce a lean vapor and a richer liquid;

(6) passing the richer liquid to the reboiling zone to form part of the reboiling liquid;

(7) withdrawing the lean vapor from the column;

(8) heating the withdrawn lean vapor;

(9) compressing the heated lean vapor;

(10) cooling the compressed lean vapor by indirect heat exchange with the heating lean vapor;

(11) condensing the cooled lean vapor in the reboiling zone by indirect heat exchange with the partially vaporizing reboiling liquid to produce a lean liquid;

(12) passing a portion of the lean liquid to the column to form said reflux liquid; and

(13) recovering a portion of the lean liquid as liquid product substantially free of rare gases.

As used herein, the term "rare gas" means krypton or xenon.

As used herein, the terms "lean", leaner", "rich" and "richer", refer to the concentration of rare gases, unless specifically indicated otherwise.

As used herein, the term "integral heat pump circuit" means an arrangement whereby the heat pump circuit is combined with the separation column and utilizes process fluid available from the separation column.

As used herein the term "reboiling zone" means a heat exchange zone where entering liquid is indirectly heated and thereby partially vaporized to produce gas and remaining liquid. The remaining liquid is thereby enriched in the less volatile components present in the entering liquid.

As used herein, the term "indirect heat exchange" means the bringing of two fluid streams into heat exchange relation without any physical contact or intermixing of the fluids with each other.

As used herein, the term "equilibrium stage" means a vapor-liquid contacting stage whereby the vapor and liquid leaving that stage are in mass transfer equilibrium. For a separation column that uses trays or plates, i.e. separate and discrete contacting stages for the liquid and gas phases, an equilibrium stage would correspond to a theoretical tray or plate. For a separation column that uses packing, i.e. continuous contacting of the liquid and gas phases, an equilibrium stage would correspond to that height of column packing equivalent to one theoretical plate. An actual contacting stage, i.e. trays, plates, or packing, would have a correspondence to an equilibrium stage dependent on its mass transfer efficiency.

As used herein, the term "column" means a distillation or fractionation column, i.e., a contacting column or zone wherein liquid and vapor phases are countercurrently contacted to effect separation of a fluid mixture, as for example, by contacting of the vapor and liquid phases on a series of vertically spaced trays or plates mounted within the column or alternatively, on packing elements with which the column is filled. For an expanded discussion of fractionation columns see the Chemical Engineer's Handbook, Fifth Edition, edited by R. H. Perry and C. H. Chilton, McGraw-Hill Book Company, New York Section 13, "Distillation" B. D. Smith et al, page 13-3, *The Continuous Distillation Process.*

The term "double column" is used herein to mean a high pressure column having its upper end in heat exchange relation with the lower end of a low pressure column. An expanded discussion of double columns appears in Ruheman, "The Separation of Gases" Oxford University Press, 1949, Chapter VII, Commercial Air Separation, and Barron, "Cryogenic Systems", McGraw-Hill, Inc., 1966, p. 230, Air Separation Systems.

DETAILED DESCRIPTION

Figure 1:
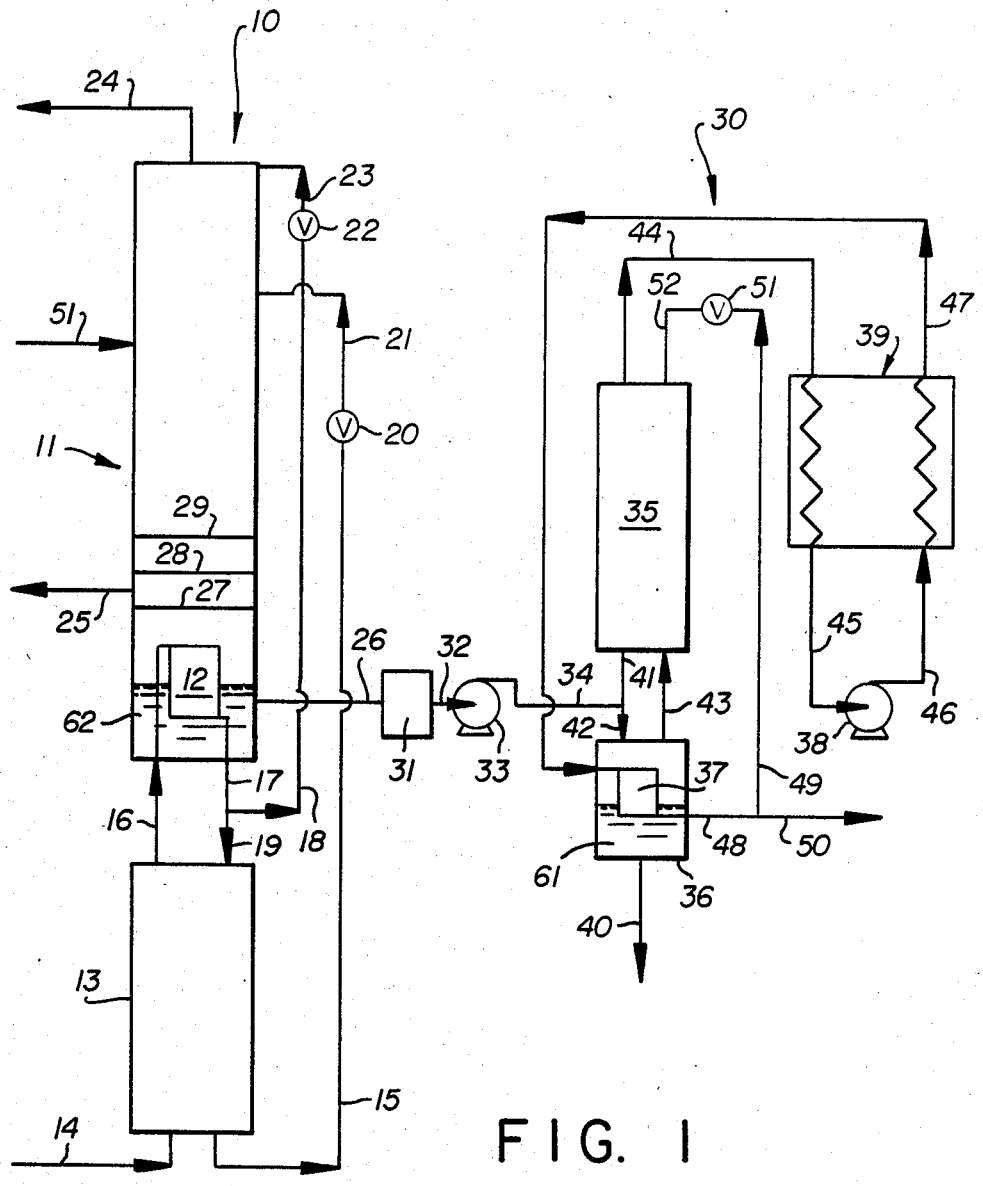
FIG. 1 is a schematic flow diagram of one preferred embodiment of the process of this invention. The schematic representation of FIG. 1 is particularly preferred in that it shows the feed to the krypton-xenon concentration process as coming from a double-column air separation plant which produces both gaseous and liquid oxygen product and shows a modification to the double-column process which enables virtually all of the krypton and xenon in the feed air to settle in the liquid oxygen rather than in the gaseous oxygen.

The process of this invention will be described in detail with reference to the drawing.

Referring now to FIG. 1, liquid stream 32 comprising oxygen, krypton and xenon is passed, such as by pump means 33, as stream 34 to reboiling zone 36. In the embodiment of FIG. 1, liquid feed stream 34 is combined with liquid from column 35 and the resulting combined stream 42 is passed to reboiling zone 36. The concentration of krypton and xenon in the liquid feed stream 34 may be any effective concentration but, in general, the concentration of krypton will be at least 10 ppm and the concentration of xenon will be at least 1 ppm in liquid feed stream 34.

The source of the liquid feed to the process of this invention may be any source of rare gas-containing liquid oxygen. FIG. 1 shows one such source as the liquid from the sump of a lower pressure column of a double column air separation process 10 which can produce both liquid and gaseous oxygen products. As shown in FIG. 1, this liquid 26 may be passed to storage reservoir 31 prior to use in the process of this invention. Storage reservoir 31 may be supplied with suitable feed liquid from sources other than or in addition to the feed from the illustrated double column air separation plant. FIG. 1 demonstrates one of the advantages of the process of this invention, in that the process need not be tied to a comprehensive air separation process. The only input to the process of this invention is liquid feed stream 34 which may be from any suitable source. The entire krypton-xenon concentration process 30, including mass transfer in the column, heat transfer in the integral heat pump circuit, and the concentrating phase change in the reboiling zone, is carried out with no other stream input to the process. This allows the process of this invention to stand alone and allows for krypton-xenon concentration with a process simplified considerably over heretofore available processes.

Referring back to FIG. 1, reboiling liquid 61 in the reboiling zone is partially vaporized by heat exchange with condensing liquid in condenser 37 resulting in a vapor 43 and a krypton-xenon concentrate 40 which may be recovered for further use. Typically the krypton concentration in concentrate 40 will be at least 200 ppm and preferably is at least 400 ppm, and the xenon concentration in concentrate 40 is at least 15 ppm and preferably is at least 30 ppm.

Vapor 43, which is leaner in krypton and xenon than is the feed liquid to the reboiling zone, is passed up through column 35 against downflowing reflux liquid. FIG. 1 illustrates reboiling zone 36 as being apart from column 35 although the reboiling zone could be within and at the bottom of column 35. When the reboiling zone is apart from column 35 as in the embodiment of FIG. 1, the vapor 43 is introduced into column 35 at the bottom of the column.

Within column 35, krypton and xenon in vapor 43 is stripped from the vapor into downflowing reflux liquid. The resulting krypton-xenon enriched liquid 41 is passed to the reboiling zone to form part of reboiling liquid 61.

Column 35 operates at a pressure in the range of from 10 to 75 psia, preferably from 15 to 30 psia, and serves to strip a significant portion, and preferably substantially all, of the krypton and xenon in vapor 43 into the downflowing reflux liquid. This results in vapor stream 44 being withdrawn from column 35, preferably at the top of column 35, in a lean condition and preferably substantially free of rare gases.

Lean vapor stream 44, comprised substantially of oxygen, is heated by indirect heat exchange in heat exchanger 39, and the heated stream 45 is compressed in compressor 38 to form compressed stream 46. Stream 45 need undergo only a small amount of compression and preferably stream 46 is at a pressure not more than 30 psi, most preferably not more than 15 psi, greater than stream 45. Although not shown, the compressed stream may be cooled versus cooling water. The compressed stream 45 is then cooled by indirect heat exchange by passage through heat exchanger 39 against the heating vapor stream 44 and the resulting cooled compressed lean vapor stream 47 is passed to condenser 37 of reboiling zone 36. Here the cooled compressed lean vapor is condensed by indirect heat exchange with the partially vaporizing reboiling liquid to produce lean liquid 48. A portion 49 of this lean liquid 48, comprising from 10 to 40 percent, preferably from 15 to 25 percent of lean liquid 48 is expanded through valve 51 and passed as steam 52, to column 35, preferably at the top of the column, to form the aforedescribed downflowing reflux liquid. Another portion 50 of lean liquid 48, preferably the remaining portion, is recovered as liquid product comprised substantially of oxygen and being substantially free of rare gases. Generally stream 50 will have a krypton concentration of not more than 5 ppm, preferably not more than 1 ppm, and a negligible xenon concentration.

As was discussed earlier the krypton-xenon concentration process of this invention requires no stream input other than the feed. It is thus seen that the feed liquid provides for the krypton-xenon mass transfer within column 35, for the heat transfer in the integral heat pump circuit associated with heat exchanger 39, and also for the concentrating phase change in reboiling zone 36. Because the heat exchange in reboiling zone 36 is between very similar fluids, i.e., both the reboiling liquid 61 and the condensing compressed lean vapor 47 are generally 99 percent or more oxygen, the heat exchange within reboiling zone 36 can be carried out with only a small amount of compression in compressor 38. This is advantageous from an energy use standpoint and also from a safety standpoint because compression of oxygen can become hazardous the greater the amount of compression. The integral heat pump circuit also serves to reduce the complexity of the concentration process since other fluids, such as nitrogen or argon, are not needed as heat exchange media. This also serves to better enable the process of this invention to stand alone, independent of other cryogenic processes.

As mentioned previously, FIG. 1 illustrates a particularly preferred arrangement wherein the liquid feed to the krypton-xenon concentration process is taken from a double column air separation which produces both gaseous and liquid oxygen product and which has been modified from the conventional dual product double column arrangement so as to place virtually all of the atmospheric krypton and xenon in the liquid product rather than the gaseous product. There now follows a brief description of the double column air separation process illustrated in FIG. 1.

Referring now to FIG. 1, feed air 14 is introduced into high pressure column 13, operating a a pressure of from 75 to 150 psia, wherein it is separated into nitrogen-richer vapor 16 and oxygen-richer liquid 15. Vapor 16 is condensed in condenser 12 by indirect heat exchange with low pressure column bottoms 62 and the resulting nitrogen-richer liquid 17 is passed to both the high pressure column, as stream 19, and to the low pressure column, as stream 18 through valve 22 and stream 23, to serve a liquid reflux for the columns. Liquid 15 is expanded through valve 20 and passed as stream 21 to the low pressure column as partially flashed feed. Air stream 51 which may be used for cold end heat exchanger temperature regulation and/or to develop plant refrigeration is also introduced into column 11 as feed. Column 11 operates at a pressure lower than column 13 and in the range of from 15 to 30 psia. Within column 11 the various input streams are separated into a nitrogen-rich component which is removed as stream 24 and an oxygen-rich component. The oxygen-rich component is withdrawn from the column as gaseous stream 25 and liquid stream 26.

In conventional dual product, i.e. liquid and gaseous oxygen, production, the gaseous oxygen product is withdrawn from above the liquid bottoms in such a manner that the two withdrawn streams are in equilibrium. Accordingly, the krypton and xenon will be in equilibirum in both the withdrawn product streams. Although the equilibirum krypton and xenon content of the liquid product is higher than that of the gas product, often the quantity of liquid product is much less than the gas product and thereby the loss of krypton and xenon with the gas product is significant. In order to overcome this situation, the double column arrangement illustrated in FIG. 1 withdraws the gaseous oxygen product 25 from column 11 at a point above at least one equilibrium stage higher than the column 11 sump, in this case above tray 27. It has been discovered that with such an arrangement, a significant amount of the krypton-xenon which would under conventional practice be removed with the gaseous product, instead remains within the liquid and thus is passed to the krypton-xenon concentration process. If desired the gaseous oxygen product may be withdrawn from even higher above the sump, such as above trays 28 or 29. The optimum removal point will depend on the value of the marginal krypton-xenon gained relative to the extra trays in the low pressure column. Generally the liquid oxygen product 26 will be from about 2 to about 75 percent of the total oxygen product from column 11, preferably from about 5 to 30 percent and most preferably about 20 percent.

The double column process illustrated in FIG. 1 is particularly advantageous when employed in conjunction with the krypton-xenon concentration process of this invention. The double column process concentrates virtually all of the atmospheric krypton and xenon in the liquid oxygen product which is then used as feed for the process of this invention. The krypton-xenon concentration process of this invention produces a liquid oxygen product stream containing only a small amount of, or negligible, rare gases. Thus, putting the two processes together as illustrated in FIG. 1, one may recover a gaseous oxygen product 25, a liquid oxygen product 50 and a krypton-xenon concentrate 40 containing virtually all of the krypton and xenon in the atmospheric air feed. This very desirable result is accomplished at high efficiency and in an uncomplicated and safe manner.

In Table I there is tabulated the results of a computer simulation of the process of this invention carried out in accord with the FIG. 1 embodiment. The data is presented for illustrative purposes and is not intended to be limiting. The abbreviations "CFH" and "PSIA" refer respectively to "cubic feet per hour" measured at ambient temperature (70° F.) and atmospheric pressure (14.7 psia), and "pounds per square inch absolute". The stream numbers correspond to those of FIG. 1. The stream concentrations are indicated in either mole percent (%) or parts per million volume (PPM). In addition to the indicated oxygen, krypton and xenon content, the streams contain some argon and minor hydrocarbons.

TABLE I

| Stream No. | 25 | 26 | 40 | 41 | 43 | 44 | 45 | 46 | 47 | 49 | 50 |
|---|---|---|---|---|---|---|---|---|---|---|---|
| Flow, CFH | 5560 | 1000 | 80 | 230 | 1150 | 1150 | 1150 | 1150 | 1150 | 230 | 920 |
| Temperature, °K. | 93.5 | 93.5 | 93.5 | 93.5 | 93.5 | 93 | 292 | 300 | 98 | 95 | 95 |
| Pressure, PSIA | 20 | 20 | 20 | 20 | 20 | 19 | 16 | 26 | 24 | 24 | 24 |

TABLE I-continued

| Stream No. | 25 | 26 | 40 | 41 | 43 | 44 | 45 | 46 | 47 | 49 | 50 |
|---|---|---|---|---|---|---|---|---|---|---|---|
| Purity | | | | | | | | | | | |
| Oxygen, % | 99.6 | 99.6 | 99.5 | 99.5 | 99.5 | 99.6 | 99.6 | 99.6 | 99.6 | 99.6 | 99.6 |
| Krypton, PPM | <0.5 | 36 | 443 | 340 | 57 | 0.3 | 0.3 | 0.3 | 0.3 | 0.3 | 0.3 |
| Xenon, PPM | <0.05 | 3.1 | 38 | 1.0 | 0.2 | — | — | — | — | — | — |

As demonstrated by the data in Table I, the process of this invention effectively produces a krypton-xenon concentrate with very little krypton and xenon lost by being in streams other than the concentrate product stream. The process of this invention accomplishes this using a liquid feed yet also produces a liquid product substantially free of rare gases. As shown in Table I the vast majority of the liquid feed, generally at least 75 percent and in this case 92 percent, is recovered as liquid oxygen product and only a small amount of the liquid feed is needed to form the krypton-xenon concentrate. Furthermore, the process of this invention is able to achieve these desirable results without any other stream inputs, such as a nitrogen or argon heat pump cycle, and without the need to return any process stream back to an air separation plant, thereby enabling this process to stand alone with no need for an associated cryogenic plant. Still further, the process of this invention, employing the defined combination of process steps and using the liquid feed as the only process stream, accomplishes all of these desirable results without the need for a large energy input to drive the separation.

I claim:

1. A process for the production of a krypton-xenon concentrate from a liquid feed, while also recovering a liquid product substantially free of rare gases, comprising enabling avoidance of excessive complication(s) occasioned by the handling of oxygen by the steps of:

(A) providing a feed liquid comprising oxygen, krypton and xenon to a reboiling zone to form a reboiling liquid;

(B) partially vaporizing the reboiling liquid to produce a vapor, and a liquid krypton-xenon concentrate;

(C) recovering krypton-xenon concentrate;

(D) passing the vapor against downflowing reflux liquid in a column;

(E) stripping krypton and xenon from the vapor to the reflux liquid to produce a lean vapor and a richer liquid;

(F) passing the richer liquid to the reboiling zone to form part of the reboiling liquid;

(G) withdrawing lean vapor from the column;

(H) heating the withdrawn lean vapor;

(I) compressing the heated lean vapor;

(J) cooling the compressed lean vapor by indirect heat exchange with the heating lean vapor;

(K) condensing the cooled lean vapor in the reboiling zone by indirect heat exchange with the partially vaporizing reboiling liquid to produce a lean liquid;

(L) passing a portion of the lean liquid to the column to form said reflux liquid; and (M) recovering a portion of lean liquid as liquid product substantially free of rare gases.

2. The process of claim 1 wherein the krypton concentration in the liquid feed is at least 10 ppm.

3. The process of claim 1 wherein the xenon concentration in the liquid feed is at least 1 ppm.

4. The process of claim 1 wherein the reboiling zone is within the column.

5. The process of claim 1 wherein the reboiling zone is separate from the column.

6. The process of claim 1 wherein the liquid feed and the richer liquid are combined prior to introduction to the reboiling zone.

7. The process of claim 1 wherein the column operates at a pressure in the range of from 10 to 75 psia.

8. The process of claim 1 wherein the heated lean vapor is compressed to increase its pressure by no more than 30 psi.

9. The process of claim 1 wherein the heated lean vapor is compressed to increase its pressure by no more than 15 psi.

10. The process of claim 1 wherein the portion of the lean liquid passed to the column as reflux liquid comprises from 10 to 40 percent of the lean liquid.

11. The process of claim 1 wherein the concentration of krypton in the krypton-xenon concentrate is at least 200 ppm.

12. The process of claim 1 wherein the concentration of xenon in the krypton-xenon concentrate is at least 15 ppm.

13. The process of claim 1 wherein the liquid product substantially free of rare gases comprises at least 75 percent of the liquid feed on a volumetric flow basis.

14. The process of claim 1 wherein the liquid feed is taken from a double column cryogenic air separation plant.

15. The process of claim 14 wherein said air separation plant produces gaseous oxygen product in addition to a liquid which forms the liquid feed.

16. The process of claim 15 wherein said gaseous oxygen product is withdrawn from the air separation plant above at least one equilibrium stage from where the liquid which forms the liquid feed is withdrawn.

* * * * *